US008444453B2

(12) United States Patent
Roser et al.

(10) Patent No.: US 8,444,453 B2
(45) Date of Patent: May 21, 2013

(54) DEVICE AND METHOD FOR FINE OR FINEST PROCESSING OF A ROTATIONALLY SYMMETRIC WORK PIECE SURFACE

(75) Inventors: Juergen Roser, Haslach (DE); Daniel Welle, Biberach (DE)

(73) Assignee: Supfina Grieshaber GmbH & Co. KG, Wolfach (DE)

( * ) Notice: Subject to any disclaimer, the term of this patent is extended or adjusted under 35 U.S.C. 154(b) by 619 days.

(21) Appl. No.: 12/656,546

(22) Filed: Feb. 3, 2010

(65) Prior Publication Data

US 2010/0210187 A1 Aug. 19, 2010

Related U.S. Application Data

(60) Provisional application No. 61/152,269, filed on Feb. 13, 2009.

(51) Int. Cl.
*B24B 5/04* (2006.01)

(52) U.S. Cl.
USPC ..... 451/11; 451/51; 451/398

(58) Field of Classification Search
USPC ..... 451/51, 324, 398, 246, 11
See application file for complete search history.

(56) References Cited

U.S. PATENT DOCUMENTS 2,078,416 A * 4/1937 Sauer ..... 451/65
6,726,544 B2 * 4/2004 Ozaki et al. ..... 451/52

* cited by examiner

*Primary Examiner* — Robert Rose
(74) *Attorney, Agent, or Firm* — Paul Vincent

(57) ABSTRACT

A device for fine or finest processing of a rotationally symmetric work piece surface of a work piece (14), with a drive mechanism (12) for driving the work piece (14) around an axis of rotation (16), two guidance mechanisms (20, 22) acting in radial directions with respect to the axis of rotation (16) and at least one tool (38) acting in a radial direction, and a pressing mechanism (42) for pressing the work piece (14) against the drive mechanism (12), wherein the work piece (14) can be disposed between the drive mechanism (12) and the pressing mechanism (42). The pressing mechanism (42) acts in a pressing plane (74) that is offset from the axis of rotation (16) towards a space (78) in which the guidance mechanisms (20, 22) are disposed.

15 Claims, 7 Drawing Sheets

DEVICE AND METHOD FOR FINE OR FINEST PROCESSING OF A ROTATIONALLY SYMMETRIC WORK PIECE SURFACE

This application claims benefit of provisional application No. 61/152,269 filed on Feb. 13, 2009 the entire disclosure of which is hereby incorporated by reference.

BACKGROUND OF THE INVENTION

The invention relates to a device for fine or finest processing of a rotationally symmetric work piece surface of a work piece, with a drive mechanism for driving the work piece around an axis of rotation, with two guidance mechanisms acting in radial directions with respect to the axis of rotation, and at least one tool acting in a radial direction, with a pressing mechanism for pressing the work piece against the drive mechanism, wherein the work piece can be disposed between the drive mechanism and the pressing mechanism as seen in the direction of the axis of rotation.

In the fine and finest processing of a rotationally symmetric work piece surface of a work piece, radial clamping poses the problem that rotationally symmetric work piece surfaces can be damaged by contact with the clamping tool. To prevent this, devices of the type stated above are used. On these devices, the work pieces are not clamped radially but axially. In this case, a work piece is fixed between a drive mechanism for driving the work piece around an axis of rotation and a pressing mechanism as seen in the direction of the axis of rotation. Positioning of the work piece in the radial direction is achieved using two guidance mechanisms.

A tool acting in the radial direction exerts a force on the work piece to be processed so that this may be displaced to the side with respect to the axis of rotation, that is, in the radial direction, unless additional measures are taken. To prevent this, it is possible, for example, to provide a third guidance mechanism so that the work piece is held between three guidance mechanisms in the radial direction. A further possibility is to provide only two guidance mechanisms, each at a different distance from the axis of rotation in the radial direction. With correct coordination of the different radial distances of the guidance mechanisms from the axis of rotation and the direction of rotation of the work piece, it is then also possible to prevent lateral displacement of the work piece by means of two guidance mechanisms. However, it is disadvantageous that, due to the offset between the axis of rotation of the drive mechanism and the real axis of rotation of the work piece, the latter moves in the radial direction relative to the drive mechanism and/or the pressing mechanism so that the end surfaces of the work piece rub against the corresponding facing surfaces of the drive mechanism and/or the pressing mechanism. This can damage the face-end surfaces of the work piece and/or the facing surfaces of the drive mechanism and/or the pressing mechanism. At the same time, stick-slip effects can occur with the consequence that the work piece cannot be processed with the necessary precision and, in particular, circular runout tolerances can no longer be complied with.

Based on the aforesaid considerations, the object of this invention is to create a device of the type stated above having the simplest possible structure that can process a work piece with low wear and high precision.

SUMMARY OF THE INVENTION

This object is achieved in the device of the type stated above by the fact that the pressing mechanism acts in a pressing plane that is offset from the axis of rotation toward a space in which the guidance mechanisms are disposed.

The pressing plane is therefore positioned eccentrically relative to the axis of rotation and thus offset toward the two guidance mechanisms. Surprisingly, this offset of the pressing plane is sufficient to exert a lateral force that presses the work piece toward the guidance mechanisms. This makes it possible to dispense with a third guidance mechanism. At the same time, it is not necessary to coordinate different distances between the first two guidance mechanisms from the axis of rotation of the work piece and a direction of rotation of the work piece.

The pressing plane preferably extends parallel to the axis of rotation. This enables the pressing forces to be exerted as perpendicular forces on a work piece to be processed that is pressed toward the drive mechanism by the pressing mechanism.

It is also preferable if the pressing plane extends between the axis of rotation and the guidance mechanisms. This can prevent lateral displacement of the work piece in an especially reliable fashion.

It is especially preferred if the guidance mechanisms have guidance surfaces for contact on at least one radial contact surface of the work piece and if the guidance surfaces are at identical distances from the axis of rotation in the radial direction. This ensures that the real axis of rotation of the work piece and the axis of rotation of the drive mechanism are collinear relative to each other. This prevents relative sliding motion between the work piece and both the drive mechanism and pressing mechanism so that the work piece is supported with especially low wear in the regions of contact with the drive mechanism and the pressing mechanism. Moreover, the device can be especially easily set up before processing of a work piece or, in particular, a series of work pieces, because the distance of the guidance surfaces from the axis of rotation can be set using only one work piece and/or only one reference part.

It is further advantageous if the guidance surfaces are supported such that they can rotate so that, when the guidance surfaces contact the contact surface of the work piece, they roll on the latter. This permits especially low-wear contact of the guidance mechanisms with the contact surface of the work piece.

It is especially preferred if the guidance surfaces are disposed with mirror symmetry relative to a plane of symmetry that extends between the axis of rotation and a direction that is perpendicular to the pressing plane. In this way, the work piece is reliably held in the radial direction irrespective of the direction of rotation.

It is beneficial if the pressing mechanism has at least one pressing surface for support on one face-end contact surface of the work piece so that high pressing forces can be exerted toward the drive mechanism.

It is also preferable if the at least one pressing surface is supported such that it can rotate so that, when the pressing surface contacts the face-end contact surface of the work piece, it rolls on the latter. This permits especially low-wear contact between the pressing mechanism and the work piece.

It is especially preferred if the pressing mechanism has at least two pressing surfaces for contact with a face-end contact surface of the work piece. In particular, the face-end contact surface of the work piece is circular or annular in shape so that the pressing surfaces contact or can contact sections of the surface of the circle or annulus with a relative distance between them.

In a preferred embodiment of the invention, the pressing surfaces are disposed with mirror symmetry with reference to a plane of symmetry that extends through the axis of rotation and a direction perpendicular to the pressing plane. In this way, the work piece can be reliably fixed irrespective of its direction of rotation.

It is also preferred if the at least one pressing surface can be moved toward the drive mechanism and away from it in a direction that is parallel to the axis of rotation. This makes it possible to initially place the pressing surface further from the drive mechanism to be able to insert a work piece into a work piece space between the drive mechanism and the pressing mechanism. After insertion of the work piece, the pressing surface can be moved toward the work piece until the pressing surface comes into contact with the work piece and the latter is pressed against the drive mechanism. After the work piece has been processed, the pressing surface can be lifted from the work piece to permit easy removal of the work piece.

In a preferred embodiment of the invention, the at least one pressing surface is supported on a holder that can be swiveled around a holder axis that is at an angle to the axis of rotation. Swiveling the pressing surface around a holder axis makes it possible to move the pressing surface along an arc so that only one component of the movement of the pressing surface extends in a direction parallel to the axis of rotation toward the pressing plane. This permits especially low-wear and precise contact of the pressing surface with a face-end contact surface of the work piece.

It is further preferred if the holder is supported on a linear drive that can be moved toward and away from the drive mechanism in a direction parallel to the axis of rotation. This makes it possible to produce pressing forces to be exerted on the drive mechanism using the linear drive.

The device for fine or finest processing is preferably a finishing device with a finishing tool, in particular, a finishing stone.

The invention further relates to a method for fine or finest processing of a rotationally symmetrical work piece surface of a work piece, with a drive mechanism for driving the work piece around an axis of rotation, with two guidance mechanisms acting in radial directions with respect to the axis of rotation and at least one tool acting in a radial direction, with a pressing mechanism for pressing the work piece against the drive mechanism, wherein the work piece is disposed between the drive mechanism and the pressing mechanism as seen in the direction of the axis of rotation, wherein the pressing mechanism is positioned in a pressing plane that is offset from the axis of rotation towards a space in which the guidance mechanisms are disposed.

The advantages and embodiments of the inventive method are already explained above with reference to the advantages and embodiments of the inventive device.

Further characteristics and advantages of the invention are the object of the description given below and of the drawings of preferred embodiments.

DESCRIPTION OF THE PREFERRED EMBODIMENT

Figure 1:
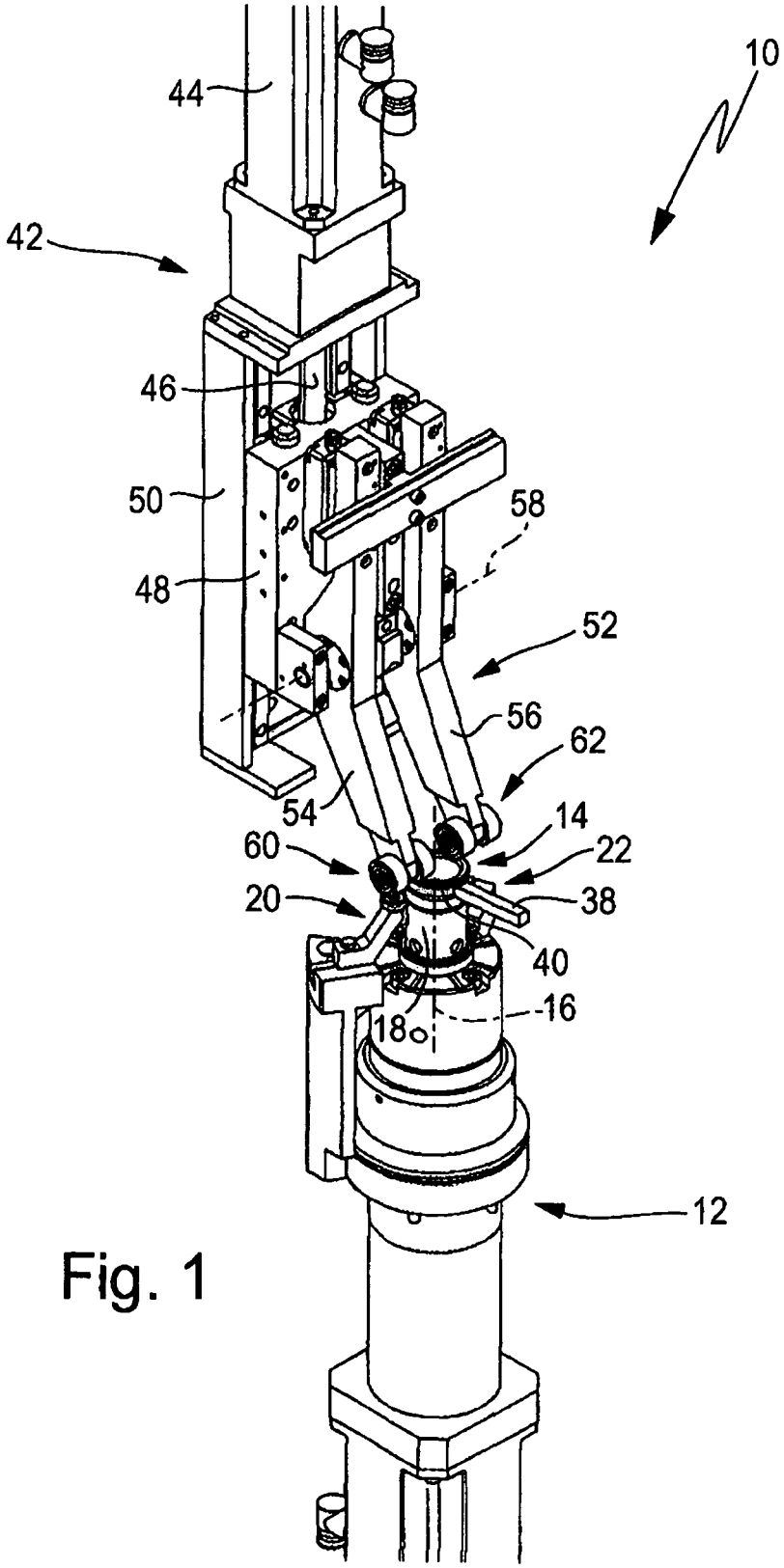
FIG. 1 a perspective view of a first embodiment of a device for fine and finest processing of a work piece.
Figure 2:
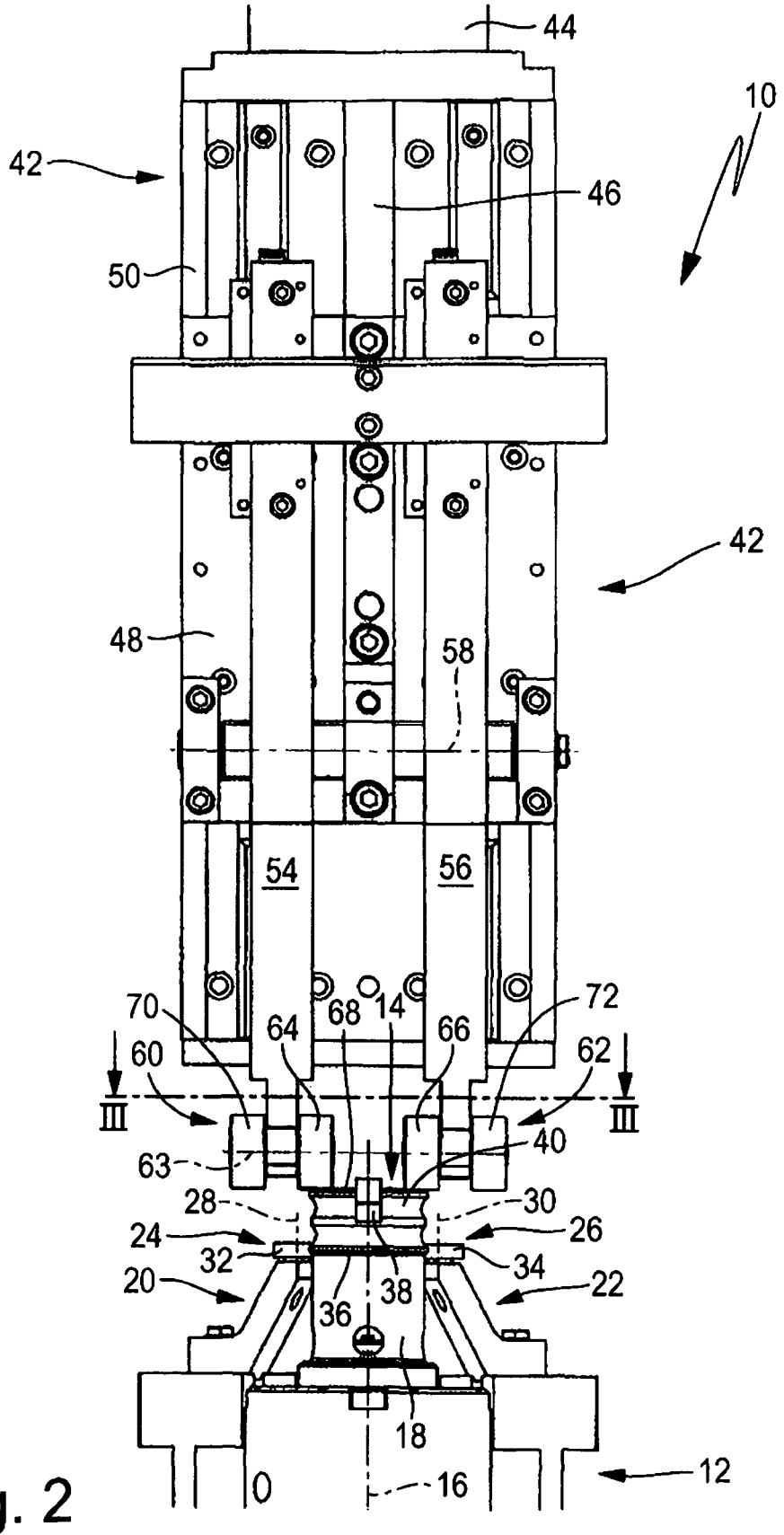
FIG. 2 a front view of the device according to FIG. 1.
Figure 3:
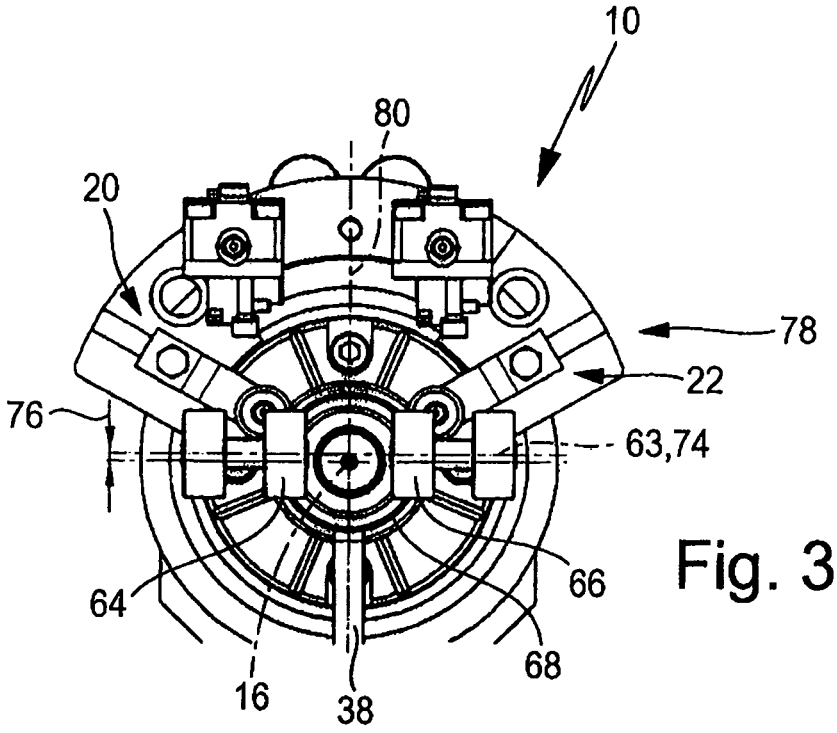
FIG. 3 a plan view of the device according to FIG. 1 along an intersecting line referenced III in FIG. 2.
Figure 7:
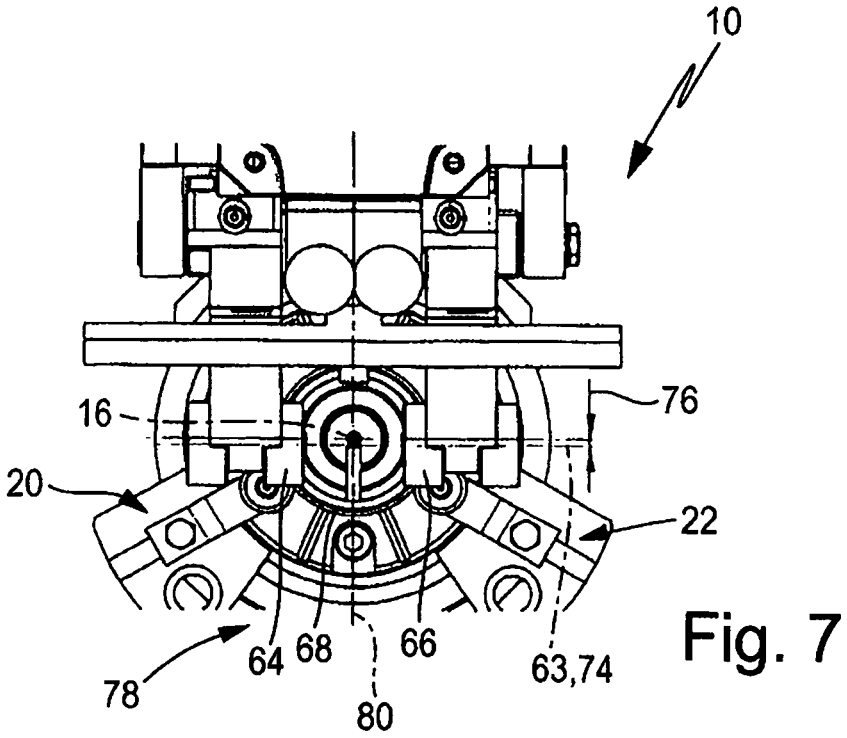
FIG. 7 a plan view of the device according to FIG. 5.
Figure 4:
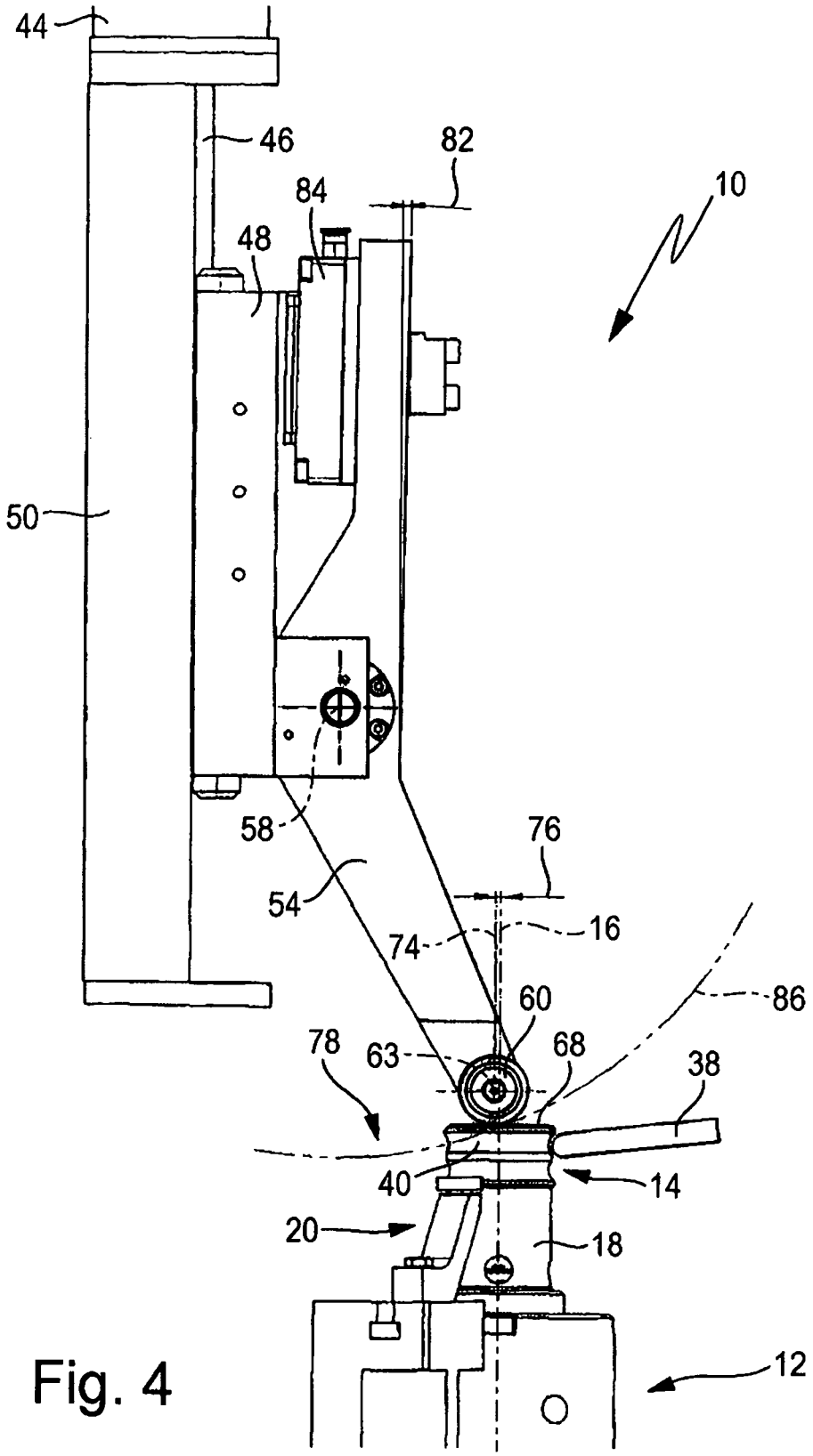
FIG. 4 a side view of the device according to FIG. 1.
Figure 5:
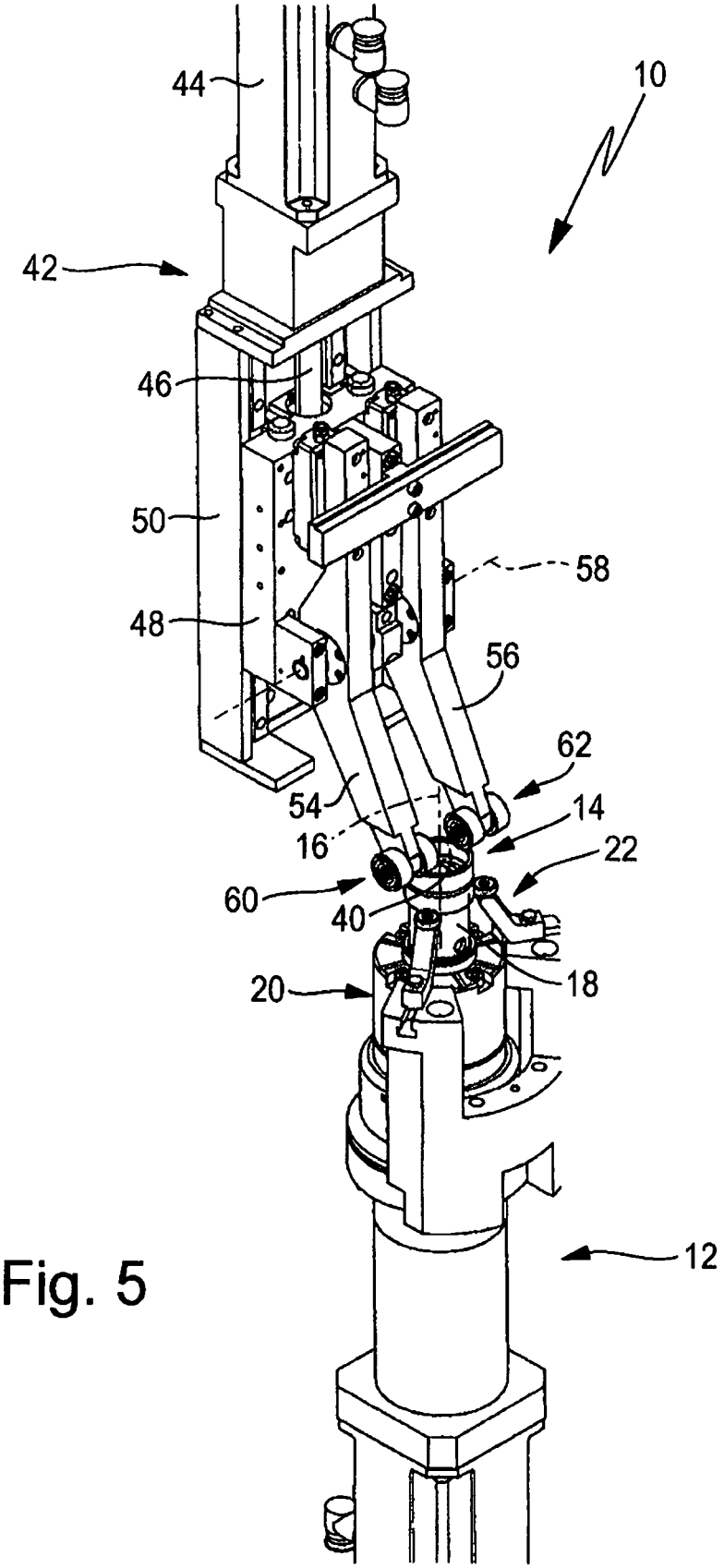
FIG. 5 a perspective view of a second embodiment of a device for fine or finest processing of a work piece.
Figure 6:
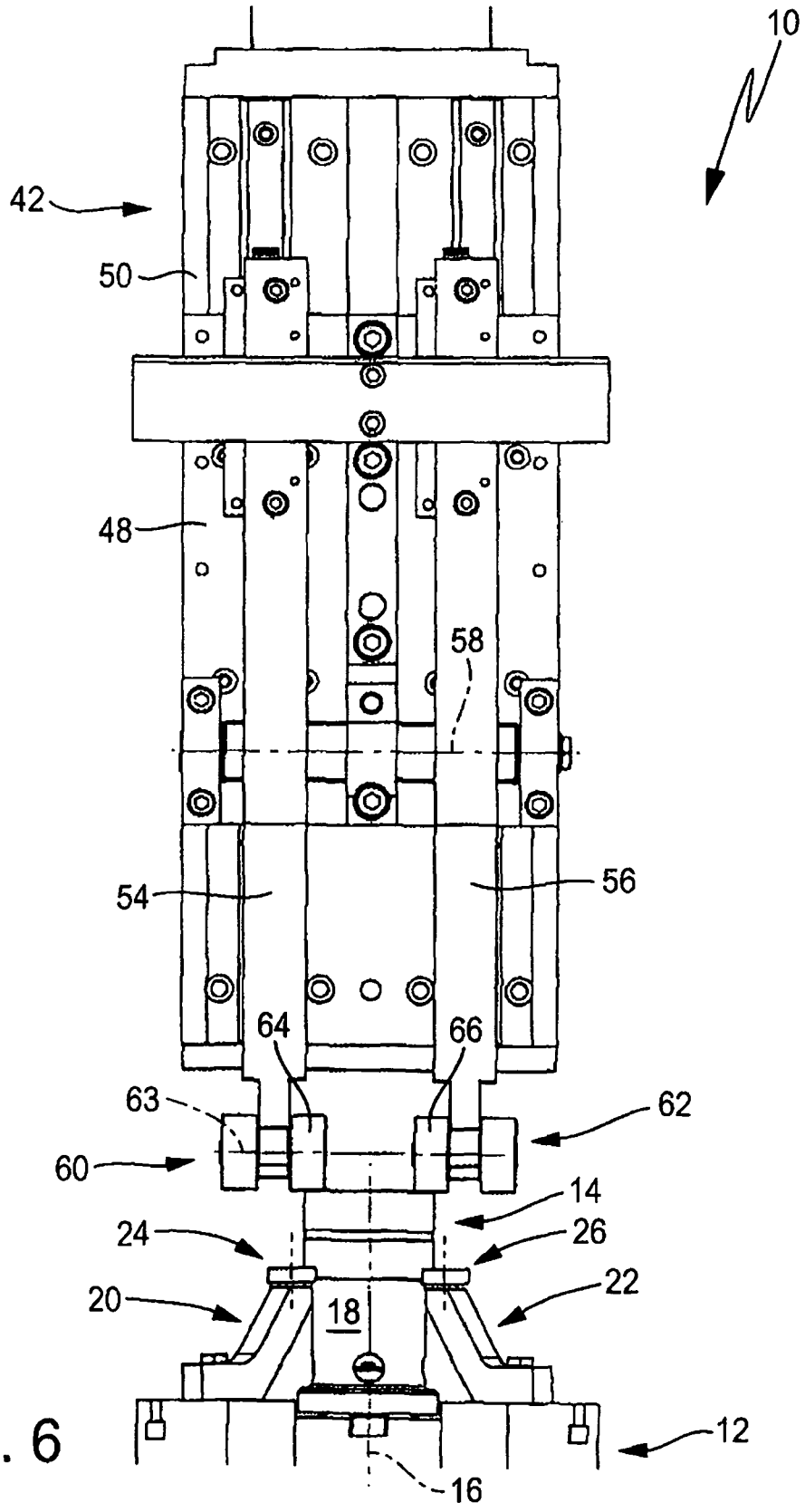
FIG. 6 a front view of the device according to FIG. 5.
Figure 8:
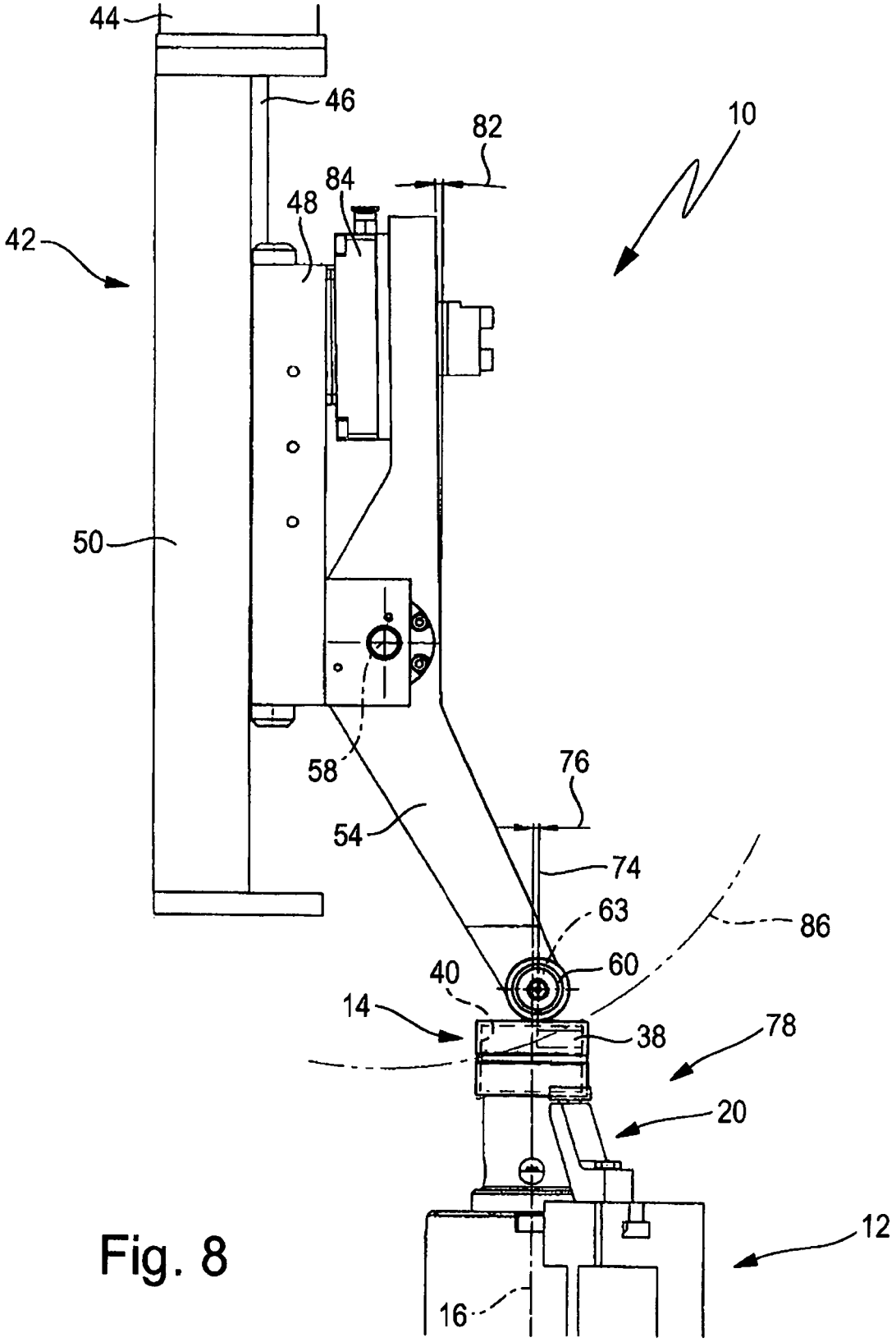
FIG. 8 a side view of the device according to FIG. 5.

A first embodiment of a device for fine or finest processing is shown in FIG. 1 and designated in its totality with reference sign 10. The device 10 is, in particular, a device for finish-machining a work piece.

The device 10 comprises a drive mechanism 12 that is disposed at the lower end and is used to drive a work piece 14 around an axis of rotation 16. The drive mechanism 12 comprises a work piece holder 18 onto which the work piece 14 can be placed upon the latter's lower end face.

The work piece 14 can be driven by frictional connection with a contact surface of the work piece holder 18 around the axis of rotation 16. To prevent radial outward displacement of the work piece 14, the device 10 comprises a first guidance mechanism 20 and a second guidance mechanism 22.

The guidance mechanisms 20 and 22 each have a guidance roller 24 and 26 that can be rotated around stationary guidance roller axles 28 and 30. The guidance roller axles 28 and 30 extend, in particular, parallel to the axis of rotation 16.

The guidance rollers 24 and 26 each have cylindrical guidance surfaces 32, 34 that are used for contacting a radial contact surface 36 of the work piece 14.

The device 10 further comprises a tool 38 that is constituted, in particular, as a finishing tool and with which a rotationally symmetric work piece surface 40 of the work piece 14 facing radially outward can be processed. For example, the work piece 14 is the inner shell of a roller bearing and work piece surface 40 is a bearing surface for a roller bearing.

The device 10 further comprises a pressing mechanism collectively referenced as 42 that is used to press the work piece 14 from above toward the drive mechanism 12, in particular, against the tool holder 18.

The pressing mechanism 42 comprises a linear drive 44 that is preferably constituted as an electric drive with a servomotor. The linear drive 44 comprises a spindle 46 for driving a slide 48 that can be stopped in different positions along the spindle axis ("NC axis"). The slide 48 is held on a slide holder 50 where it is supported such that it can slide.

The movement of the spindle 46 of the linear drive 44 moves the slide 48 in a direction that is parallel to the rotation axis 16.

On the slide 48, a holder collectively referenced as 52 is supported such that it can swivel. The holder 52 comprises, in particular, two holder arms 54 and 56. The holder 52 with its holder arms 54, 56 can be swiveled around a holder axis 58 that extends at an angle, in particular, perpendicularly to the axis of rotation 16 and is offset relative to the latter ("skewed disposition of the holder axis 58 and of the axis of rotation 16").

The pressing mechanism 42 comprises at least one, preferably two, pressing elements 60, 62 that are constituted, in particular, in the form of pressing rollers.

The pressing elements 60, 62 are, preferably, rotatable around a pressing element axis 63 that is oriented, in particular, perpendicular to the axis of rotation 16 and is offset with respect to the latter.

The pressing elements 60 and 62 each have at least one pressing surface 64, 66 that are, in particular, cylindrical. The first pressing surface 64 and the second pressing surface 66 have a distance between them such that they can be placed on different sections of a face-end contact surface 68 of the work piece 14.

If the pressing elements 60 and 62, as are shown in the drawing, have additional pressing surfaces 70, 72 distributed along the pressing element axis 63, the pressing mechanism 42 can, while retaining the distance between the holder arms 54 and 56, also be used for work pieces 14 that have face-end contact surfaces 68 of different sizes, in particular, with different external diameters.

The pressing surfaces 64 and 66 and/or the pressing surfaces 70 and 72 act in a pressing plane 74 that extends parallel to the axis of rotation 16. Within the pressing plane 74, perpendicular forces act that press the work piece 14 toward the work piece holder 18. In this case, each of the pressing elements 60, 62 is in contact with different sections of the face-end contact surfaces 68 of the work piece 14 along a contact line. These contact lines preferably also extend within the pressing plane 74.

With respect to the axis of rotation 16, the pressing plane 74 is offset by an offset 76 towards a space 78, in which the guidance mechanisms 20 and 22 are disposed. The offset 76 is, for example, a few millimeters, preferably at least approximately 1 millimeter.

It is preferred if the guidance mechanisms 20, 22 and the pressing elements 60, 62 are disposed with mirror symmetry with respect to a plane of symmetry 80. The plane of symmetry 80 extends through a direction perpendicular to the pressing plane 74 and through the axis of rotation 16.

The device 10 functions as follows:

In an initial condition, the pressing mechanism 42 is positioned so far from the drive mechanism 12 that a work piece 14 can be placed on the work piece holder 18. The work piece 14 is then placed onto the work piece holder 18 by a lower face-end surface in such a way that the radial contact surface 36 of the work piece 14 comes into contact with the guidance surfaces 32, 34 of the guidance elements 20, 22. Then the slide 48 is moved by means of the linear drive 44 in the direction parallel with the axis of rotation 16 toward the work piece 14 so that the pressing elements 60 and 62 are pressed by their pressing surfaces 64, 66 against the face-end contact surface 68 of the work piece 14.

In addition or as an alternative to this, it is possible to control the linear drive 44 in such a way that the pressing surfaces 64 and 66 of the pressing elements 60 and 62 are initially still at a distance from the face-end contact surface 68 of the work piece 14 and in a next step the holder arms 54 and 56 are swiveled through an angle 82 around the holder axis 58. This swivel movement can be supported using a clamping module 84. Moving the holder arms 54, 56 around the holder axis 58 moves the pressing elements 60, 62 along an arc 86 so that the pressing surfaces 64 and 66 can be placed with especially low-wear and high precision on the face-end contact surface 68 of the work piece 14.

As an alternative to the swivel movement described, it is possible to provide an additional linear drive that moves the pressing elements 60 and 62 in a direction that is parallel to the offset 76 or inclined with respect to the latter, preferably along an NC axis.

Due to the offset 76 between the pressing plane 74 and the axis of rotation 16 toward the guidance mechanisms 20 and 22, the rotation drive of the work piece 14 exerts a force that presses the work piece 14 against the guidance mechanisms 20 and 22. This prevents lateral displacement of the work piece 14 so that the rotationally symmetric work piece surface 40 of the work piece 14 to be processed can be processed especially precisely using tool 38.

Additionally, processing of the work piece surface 40 using the tool 38 produces a machining force that presses the work piece 14 toward the guidance mechanisms 20, 22.

A second embodiment shown in FIGS. 5 to 8 of a device 10 for fine or finest processing of a rotationally symmetrical work piece surface 40 has a similar structure to the first embodiment of a device 10 described previously with reference to the FIGS. 1 to 4. For that reason, only the differences from the first embodiment of the device 10 described above are mentioned below.

The second embodiment of the device 10 has a tool 38 that is positioned within the ring-shaped work piece 14 so that a work piece surface 40 of the work piece 14 facing radially inward can be processed. For example, work piece 14 is an outer shell of a roller bearing and the work piece surface 40 is a contact surface for a rolling element.

For all other aspects, please refer to the description of the first embodiment of the device 10 for the structure and method of functioning of the second embodiment.

We claim:

1. A device for fine or finest processing of a rotationally symmetric work piece surface of a work piece, the device comprising:

a drive mechanism for driving the work piece around an axis of rotation;

two guidance mechanisms acting on the work piece in radial directions with respect to said axis of rotation;

at least one tool acting on the work piece in a radial direction; and a pressing mechanism for pressing the work piece against said drive mechanism when, as seen in a direction of said axis of rotation, the work piece is disposed between said drive mechanism and said pressing mechanism, wherein said pressing mechanism acts in a pressing plane that is offset from said axis of rotation toward a region in which said guidance mechanisms are disposed, said pressing plane is therefore positioned eccentrically relative to said axis of rotation and is offset toward said two guidance mechanisms.

2. The device of claim 1, wherein said pressing plane extends parallel to said axis of rotation.

3. The device of claim 1, wherein said pressing plane extends between said axis of rotation and said guidance mechanisms.

4. The device of claim 1, wherein said guidance mechanisms have guidance surfaces on at least one radial contact surface of the work piece, said guidance surfaces being at identical distances from said axis of rotation in a radial direction.

5. The device of claim 4, wherein said guidance surfaces are supported such that they can rotate, wherein said guidance surfaces roll along a contact surface of the work piece or of a work piece holder.

6. The device of claim 4, wherein said guidance surfaces are disposed with mirror symmetry with respect to a plane of symmetry that extends through said axis of rotation and through a direction that is perpendicular to said pressing plane.

7. The device of claim 1, wherein said pressing mechanism has at least one pressing surface for contacting a face-end contact surface of the work piece.

8. The device of claim 7, wherein said at least one pressing surface is supported and structured to roll on the face-end contact surface of the work piece when said pressing surface contacts the workpiece.

9. The device of claim 1, wherein said pressing mechanism has at least two pressing surfaces for contacting a face-end contact surface of the work piece.

10. The device of claim 9, wherein said pressing surfaces are disposed with mirror symmetry with respect to a plane of symmetry that extends through said axis of rotation and a direction that is perpendicular to said pressing plane.

11. The device of claim 7, wherein said at least one pressing surface can be moved towards and away from said drive mechanism in a direction that is parallel to said axis of rotation.

12. The device of claim 7, wherein said at least one pressing surface is supported on a holder that can be pivoted around a holder axis that is at an angle to said axis of rotation.

13. The device of claim 12, wherein said holder is supported on a linear drive that can be moved towards and away from said drive mechanism in a direction that is parallel to said axis of rotation.

14. The device of claim 1, wherein the device is a finishing device and the tool is finishing tool or a finishing stone.

15. A method for fine or finest processing of a rotationally symmetric work piece surface of a work piece, the method comprising the steps of:

a) driving the work piece around an axis of rotation using a drive mechanism;

b) acting on the work piece in radial directions with respect to the axis of rotation using two guidance mechanisms;

c) acting in a radial direction on the work piece using at least one tool;

d) positioning a pressing mechanism in a pressing plane that is offset from the axis of rotation towards a region in which the guidance mechanisms are disposed, the pressing plane therefore being positioned eccentrically relative to the axis of rotation and offset toward the two guidance mechanisms; and e) pressing, following step d), the work piece against the drive mechanism using the pressing mechanism when the work piece is disposed, as seen in the direction of the axis of rotation, between the drive mechanism and the pressing mechanism.

* * * * *